US009267473B2

(12) United States Patent
Troxler

(10) Patent No.: US 9,267,473 B2
(45) Date of Patent: Feb. 23, 2016

(54) FUEL PUMP ASSEMBLY WITH GROUNDED PLASTIC COMPONENTS AND FUEL TANK ASSEMBLY THEREWITH AND METHOD OF CONTRUCTION THEREOF

(75) Inventor: John E. Troxler, Logansport, IN (US)

(73) Assignee: Carter Fuel Systems LLC, Cleveland, OH (US)

( * ) Notice: Subject to any disclaimer, the term of this patent is extended or adjusted under 35 U.S.C. 154(b) by 890 days.

(21) Appl. No.: 13/447,843

(22) Filed: Apr. 16, 2012

(65) Prior Publication Data

US 2013/0269659 A1 Oct. 17, 2013

(51) Int. Cl.
*F02M 37/10* (2006.01)
*F02M 37/08* (2006.01)
*F02M 37/22* (2006.01)

(52) U.S. Cl.
CPC ..... *F02M 37/106* (2013.01); *F02M 2037/082* (2013.01); *F02M 2037/225* (2013.01); *F02M 2037/228* (2013.01); *Y10T 29/49236* (2015.01)

(58) Field of Classification Search
CPC ..... F02M 21/0296; F02M 37/106; F02M 2037/082; F02M 2037/225; F02M 2037/228; F02M 2200/9038; B32B 2307/202; Y10T 29/49236
USPC ..... 123/497
See application file for complete search history.

(56) References Cited

U.S. PATENT DOCUMENTS

| | | | | |
|---|---|---|---|---|
| 3,943,273 | A | 3/1976 | de Putter | |
| 5,382,359 | A * | 1/1995 | Brandt | 210/243 |
| 5,798,048 | A | 8/1998 | Ries | |
| 6,047,685 | A | 4/2000 | Schelhas et al. | |
| 6,129,074 | A | 10/2000 | Frank | |
| 6,168,713 | B1 | 1/2001 | Sekine et al. | |
| 6,206,035 | B1 | 3/2001 | Wehner et al. | |
| 6,358,022 | B1 * | 3/2002 | Frank et al. | 417/423.9 |
| 6,442,012 | B2 | 8/2002 | Koike et al. | |
| 6,453,870 | B1 * | 9/2002 | Koller et al. | 123/198 E |
| 6,589,420 | B1 * | 7/2003 | Mathew | 210/243 |
| 6,679,227 | B2 | 1/2004 | Sawert et al. | |
| 6,969,463 | B2 | 11/2005 | Mathew | |
| 7,690,692 | B2 | 4/2010 | Athalye et al. | |
| 2003/0173280 | A1 * | 9/2003 | Mathew | 210/243 |
| 2005/0121003 | A1 * | 6/2005 | Sawert et al. | 123/509 |

(Continued)

FOREIGN PATENT DOCUMENTS

| | | | |
|---|---|---|---|
| DE | 19519481 | A1 | 11/1996 |
| DE | 19843021 | C1 | 3/2000 |
| EP | 0965747 | A1 | 12/1999 |

OTHER PUBLICATIONS

International Search Report mailed Apr. 24, 2013 (PCT/US2013/026578).

*Primary Examiner* — Hieu T Vo
*Assistant Examiner* — Arnold Castro
(74) *Attorney, Agent, or Firm* — Jones Day

(57) ABSTRACT

A vehicle fuel pump assembly, method of construction thereof, and a fuel tank assembly is provided. The fuel pump assembly includes a non-conductive plastic reservoir and an electrically powered fuel pump disposed in the reservoir. The fuel pump is configured to receive fuel through an inlet and to dispense fuel through an outlet. A fuel filter assembly having a non-conductive plastic housing is disposed in the reservoir and a coating of conductive material is bonded to the housing. A conductive lead is configured in electrical communication with the coating and is further configured for attachment to an electrical ground.

24 Claims, 1 Drawing Sheet

(56) References Cited

U.S. PATENT DOCUMENTS

2007/0075087 A1* 4/2007 Knight ..... 220/562
2007/0275172 A1* 11/2007 Cowles et al. ..... 427/384
2008/0295808 A1* 12/2008 Tateishi et al. ..... 123/497
2011/0114189 A1 5/2011 Crain et al.
2011/0135884 A1 6/2011 Lettow et al.
2014/0216416 A1* 8/2014 Novaco et al. ..... 123/495

* cited by examiner

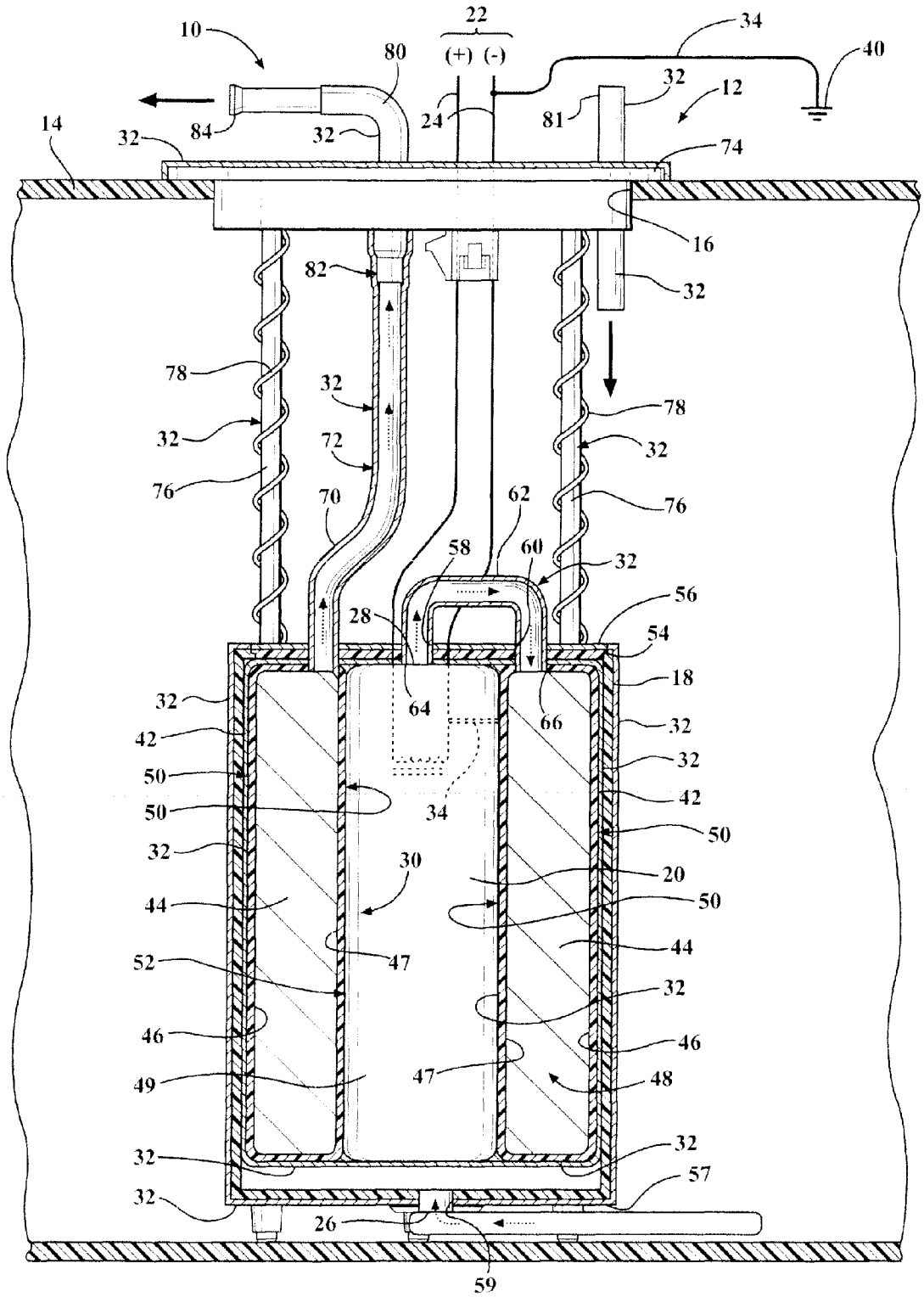
10
22
(+) (-)
34
40
80
32
12
84
24
81
14
74
16
82
78
72
70
62
58
60
56
28
54
18
64
66
42
50
30
20
44
47
52
46
49
48
57
26
59

FUEL PUMP ASSEMBLY WITH GROUNDED PLASTIC COMPONENTS AND FUEL TANK ASSEMBLY THEREWITH AND METHOD OF CONTRUCTION THEREOF

BACKGROUND OF THE INVENTION

1. Technical Field

This invention relates generally to a fuel system for an internal combustion engine, and more particularly to in-tank fuel pump assemblies.

2. Related Art

Modern vehicles are known to incorporate fuel tanks with fuel pumps contained therein, sometimes referred to as in-tank fuel pumps, wherein the fuel pumps have components constructed from impregnated conductive plastic materials, wherein the plastic is mixed with the conductive material and molded. Accordingly, the conductive plastic materials are molded from a mixture of plastic and conductive material which are premixed in a plastic resin manufacturing process. The conductive material within the molded component provides a conductive path through which electrostatic charges can be dissipated while also providing shielding against electromagnetic interference (EMI). However, a problematic issue with this type of molded material is the unpredictability of the conductive path and EMI protection provided. With the inherent variations of conductive material content and disbursement within the plastic material, the ability to provide a uniform and effective conductive path and barrier to EMI is jeopardized.

SUMMARY OF THE INVENTION

In accordance with one aspect of the invention, a vehicle fuel pump assembly is provided. The fuel pump assembly includes a non-conductive plastic reservoir and an electrically powered fuel pump disposed in the reservoir. The fuel pump is configured to receive fuel through an inlet and to dispense fuel through an outlet. A fuel filter assembly having a non-conductive plastic housing is disposed in the reservoir and a coating of conductive material is bonded to the housing. A conductive lead is configured in electrical communication with the coating and is further configured for attachment to an electrical ground.

In accordance with another aspect of the invention, a coating of conductive material is bonded to the reservoir.

In accordance with another aspect of the invention, a cover, configured for attachment about an opening of a fuel tank, is attached to the reservoir by a plurality of support members. The cover and support members have a coating of conductive material bonded thereto.

In accordance with another aspect of the invention, a fuel tank assembly is provided. The fuel tank assembly includes a fuel tank having an opening with a non-conductive plastic reservoir, an electrical fuel pump and a fuel filter assembly disposed in the fuel tank. The fuel pump is configured in electrical communication with a power source via a lead wire to receive fuel through an inlet and to dispense fuel through an outlet. Further, a coating of conductive material is bonded to the fuel filter assembly and a conductive lead is configured in electrical communication with the coating and configured for attachment to an electrical ground.

In accordance with another aspect of the invention, a coating of conductive material is bonded to the reservoir of the fuel pump assembly.

In accordance with another aspect of the invention, a method of constructing a fuel pump assembly is provided.

The method includes providing a non-conductive plastic reservoir and disposing a fuel filter assembly and an electrically powered fuel pump in the reservoir. The method further includes bonding a coating of conductive material to the fuel filter assembly, and configuring a conductive lead in electrical communication with the coating and for attachment to an electrical ground.

In accordance with another aspect of the invention, the method further includes performing the bonding by dipping the fuel filter assembly in a solution of the conductive material.

In accordance with another aspect of the invention, the method further includes bonding a coating of conductive material to the reservoir.

In accordance with another aspect of the invention, the method further includes performing the bonding by dipping the fuel filter assembly and reservoir in a solution of the conductive material.

In accordance with another aspect of the invention, the method further includes bonding the coating of conductive material to the fuel filter assembly and reservoir after disposing the fuel filter assembly in the reservoir.

In accordance with another aspect of the invention, the method further includes attaching a cover configured for attachment about an opening of a fuel tank to the reservoir with a plurality of support members and bonding a coating of conductive material to the cover and support members.

In accordance with another aspect of the invention, the method further includes bonding the coating of conductive material to the reservoir, fuel filter assembly, cover and support members in a single dipping process.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

FIG. 1 is a partially cross-sectioned side view of a fuel tank assembly and fuel pump assembly constructed in accordance with one aspect of the invention.

DETAILED DESCRIPTION OF PRESENTLY PREFERRED EMBODIMENTS

Referring in more detail to the drawings, FIG. 1 illustrates a fuel tank assembly 10 and fuel pump assembly 12 disposed therein, both constructed in accordance with the invention. The fuel tank assembly 10 includes a fuel tank 14 having an opening 16 through which the fuel pump assembly 12 is disposed for containment within the fuel tank 14, thereby being an "in-tank" fuel pump assembly. The fuel pump assembly 12 includes a non-conductive plastic reservoir 18 with an electrical fuel pump 20 disposed in the reservoir 18. The fuel pump 20 is configured in electrical communication with a power source 22 via conductive leads 24 and is powered to draw fuel through an inlet 26 and to pump fuel through an outlet 28. The fuel pump assembly 12 has a fuel filter assembly 30 disposed in the reservoir 18, with the fuel filter assembly 30 being provided as a toroid shaped cartridge surrounding the fuel pump 20. To dissipate static electricity and to provide a shield against electromagnetic interference (EMI), the fuel filter assembly 30 has a conductive material coating 32 bonded thereto. The conductive material coating 32 is applied in a dipping process, and thus, it encapsulates or substantially encapsulates the entire fuel filter assembly 30 to provide maximum coating coverage, thereby providing an uninterrupted conductive layer for maximum, reliable static electricity discharge and EMI protection. Accordingly, a reliable conductive path, represented schematically by a conductive lead 34, is provided between the lead 34 that is in electrical communication with the coating 32 and an electrical ground 40 of the vehicle.

The fuel filter assembly 30 has a fuel filter housing 42 configured for receipt of a fuel filter 44. The fuel filter housing 42 is illustrated as being toroid shaped, having generally cylindrical outer and inner walls 46, 47 bounding an inner toroid shaped cavity 48 configured for receipt of the fuel filter 44, with the inner wall 47 bounding a central passage 49 configured for close receipt of the fuel pump 20. The housing 42 is dipped in the conductive coating 32, and thus, an outer surface 50 of the inner and outer walls 46, 48 has the coating 32 bonded thereto. As such, the conductive coating 32, upon disposing the fuel pump 20 in the passage 49, is brought into electrical communication with a metal housing 52 of the fuel pump 20.

The non-conductive plastic reservoir 18 is configured for receipt of the fuel filter assembly 30 through an open end 54. A base 57 of the reservoir 18 has an opening 59 configured for receipt of the fuel pump inlet 26, and thus, after disposing the fuel filter assembly 30 in the reservoir 18, the inlet 26 is received in the opening 59 and an end cover 56 is attached to close or substantially close the open end 54. The end cover 56, as with the reservoir 18, is constructed of non-conductive plastic material. The end cover 56 has a plurality of openings configured for the flow of fuel therethrough. For example, a pair of the openings 58, 60 are configured for receipt of opposite ends of a U-shaped tube 62. One end 64 of the U-shaped tube 62 is attached in fluid communication with the outlet 28 of the fuel pump 20 and another end 66 directs the high pressure fuel into the cavity 48 of the fuel filter assembly 30. Accordingly, the fuel flows into the cavity 48 and through the fuel filter 44 under high pressure and is directed to flow outwardly from the reservoir 18 through another opening 68 in the cover 56. The fuel exiting the reservoir 18 is pumped under high pressure through a non-conductive plastic fuel supply tube 70. The supply tube 70, being operably attached to the housing 42, is dipped in the conductive coating 32, and thus, an outer surface 72 of the supply tube 70 has the coating 32 bonded thereto. As such, the conductive coating 32 continuous or substantially continuous about the entire surface of the fuel filter assembly 30.

The fuel pump assembly 12 includes a cover 74 that is operably attached to the reservoir 18 by a plurality of support members 76. The cover 74 and support members 76 are preferably constructed from non-conductive plastic and subsequently dipped in the conductive coating 32 along with the entire fuel pump assembly 12. The cover 74 is configured for attachment about the opening 16 of the fuel tank 14, wherein the support members 76 extend into the fuel tank 14 to bring the fuel pump assembly 12 into its desired location. As is known, spring members 78 can be disposed about the support members 76 to allow proper positioning the reservoir 18 within the fuel tank 14. During insertion, the support members 76 can be caused to slide into the reservoir 18 and into the housing 42 (not shown in detail), while the spring members 78 become compressed. With both the cover 74 and support members 76 both having the bonded conductive coating 32, the entire outer surface of the fuel pump assembly 12 provides a uniform and reliable conductive flow path through which static electricity (produced substantially by the flow of fuel) can flow, and further, provides a complete barrier to EMI. The cover 74 is shown supporting and receiving an outlet tube 80 and a return tube 81 therethrough. The outlet tube 80 has one end 82 configured for attachment to the supply tube 70 and an opposite end 84 configured for attachment to a fuel supply line (not shown) that channels fuel to an engine of the vehicle. The return tube 81 is configured to redirect fuel otherwise not burned or channeled to the engine back to the reservoir 18. The outlet tube 80 and return tube 81 can both be made from non-conductive plastic tube material, and being attached to the cover 74, both generally have the conductive coating 32 bonded thereto.

The conductive lead 34, being in electrical communication with the conductive coating 32 and the ground 40, is able to dissipate any electrical static charge generated within the fuel pump assembly 12 to the ground 40 in an economical and reliable fashion.

With the coating 32 covering all or substantially all exposed surfaces of the fuel pump assembly 12, and with the coating 32 having a uniform or substantially uniform thickness and continuity, the conductive path provided to dissipate the electrical static charge is made uniform and reliable, while the at the same time, allowing the construction of the non-conductive plastic components to be economical, given they are constructed from any suitable, readily available standard plastic material.

The conductive coating 32, such as those sold under the name Electrodag by Ladd Research of Williston, Vt., by way of example and without limitation, can be applied in the dipping process to each or selected ones of the non-conductive plastic components of the fuel pump assembly 12, either individually or simultaneously as an assembly or subassembly. Accordingly, the fuel pump assembly 12 can be entirely or partially assembled, and thereafter, dipped as a complete assembly or subassembly in a solution of desired conductive material. As such, the process of manufacture is made economical by dipping the entire or substantially entire fuel pump assembly 12 in a single dipping process. In addition to being economical, all surfaces are assured of being uniformly coated, thereby ensuring full and reliable conductivity across the entirety of the fuel pump assembly 12 and grounding thereof.

Many modifications and variations of the present invention are possible in light of the above teachings. It is, therefore, to be understood that the invention may be practiced otherwise than as specifically described, and that the scope of the invention is defined by any ultimately allowed claims.

What is claimed is:

1. A vehicle fuel pump assembly, comprising:

a non-conductive plastic reservoir;

an electrically powered fuel pump disposed in said reservoir, said fuel pump being configured to receive fuel through an inlet and to dispense fuel through an outlet;

a fuel filter assembly having a non-conductive plastic housing disposed in said reservoir;

a coating of conductive material bonded to an exterior surface of said housing; and a conductive lead configured in electrical communication with said coating and being configured for attachment to an electrical ground.

2. The vehicle fuel pump assembly of claim 1 further including a coating of conductive material bonded to said reservoir.

3. The vehicle fuel pump assembly of claim 2 wherein said conductive lead is configured in electrical communication with said coating on said reservoir.

4. The vehicle fuel pump assembly of claim 3 further including a cover attached to said reservoir by a plurality of support members, said cover being configured for attachment about an opening of a fuel tank, said cover having a coating of conductive material bonded thereto.

5. The vehicle fuel pump assembly of claim 4 wherein said conductive lead is configured in electrical communication with said coating on said cover.

6. The vehicle fuel pump assembly of claim 4 wherein said plurality of support members have a coating of conductive material bonded thereto.

7. The vehicle fuel pump assembly of claim 1 wherein said fuel filter assembly is toroidal and surrounds said fuel pump.

8. The vehicle fuel pump assembly of claim 1 wherein said fuel pump is in electrical communication with said coating.

9. A fuel tank assembly, comprising:

a fuel tank having an opening;

a non-conductive plastic reservoir disposed in said fuel tank;

an electrical fuel pump disposed in said reservoir, said fuel pump being configured in electrical communication with a power source via a lead wire and being powered to receive fuel through an inlet and to dispense fuel through an outlet;

a fuel filter assembly disposed in said reservoir;

a coating of conductive material bonded to an exterior surface of said fuel filter assembly; and a conductive lead configured in electrical communication with said coating and configured for attachment to an electrical ground.

10. The fuel tank assembly of claim 9 further including a coating of conductive material bonded to said reservoir.

11. The fuel tank assembly of claim 10 wherein said conductive lead is configured in electrical communication with said coating on said reservoir.

12. The fuel tank assembly of claim 11 further including a cover attached to said reservoir by a plurality of support members, said cover being configured for attachment about said opening of said fuel tank, said cover having a coating of conductive material bonded thereto.

13. The fuel tank assembly of claim 12 wherein said conductive lead is configured in electrical communication with said coating on said cover.

14. The fuel tank assembly of claim 12 wherein said plurality of supp01i members have a coating of conductive material bonded thereto.

15. The fuel tank assembly of claim 9 wherein said fuel filter assembly is toroidal and surrounds said fuel pump.

16. The fuel tank assembly of claim 9 wherein said fuel pump is in electrical communication with said coating.

17. A method of constructing a fuel pump assembly, comprising:

providing a non-conductive plastic reservoir;

disposing a fuel filter assembly in the reservoir;

disposing an electrically powered fuel pump disposed in the reservoir;

bonding a coating of conductive material to an exterior surface of the fuel filter assembly; and configuring a conductive lead in electrical communication with the coating and for attachment to an electrical ground.

18. The method of claim 17 further including performing the bonding by dipping the fuel filter assembly in a solution of the conductive material.

19. The method of claim 17 further including bonding a coating of conductive material to the reservoir.

20. The method of claim 19 further including performing the bonding by dipping the fuel filter assembly and reservoir in a solution of the conductive material.

21. The method of claim 20 further including bonding the coating of conductive material to the fuel filter assembly and reservoir after disposing the fuel filter assembly in the reservoir.

22. The method of claim 17 further including attaching a cover configured for attachment about an opening of a fuel tank to the reservoir with a plurality of support members and bonding a coating of conductive material to the cover and support members.

23. The method of claim 22 further including bonding the coating of conductive material to the reservoir, fuel filter assembly, cover and support members in a single dipping process.

24. The method of claim 17 further including configuring the fuel pump in electrical communication with the coating of conductive material.

* * * * *